US008123432B1

(12) United States Patent
Steffen

(10) Patent No.: US 8,123,432 B1
(45) Date of Patent: Feb. 28, 2012

(54) SOIL-COMPACTOR WITH POWER STEERING

(75) Inventor: Michael Steffen, Stockdorf (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 0 days.

(21) Appl. No.: 09/889,183

(22) PCT Filed: Mar. 21, 2000

(86) PCT No.: PCT/EP00/02512
§ 371 (c)(1),
(2), (4) Date: Jul. 10, 2001

(87) PCT Pub. No.: WO00/56984
PCT Pub. Date: Sep. 28, 2000

(30) Foreign Application Priority Data

Mar. 23, 1999 (DE) ..... 199 13 074

(51) Int. Cl.
*E01C 19/32* (2006.01)

(52) U.S. Cl. ..... 404/84.05; 404/133.05; 404/133.1

(58) Field of Classification Search ..... 404/84.05, 404/133.05, 133.1; 74/87, 61
See application file for complete search history.

(56) References Cited

U.S. PATENT DOCUMENTS

| | | | | |
|---|---|---|---|---|
| 3,832,080 | A * | 8/1974 | Stoecker | 404/133.1 |
| 3,972,637 | A * | 8/1976 | Sutherland | 404/133.1 |
| 4,356,736 | A * | 11/1982 | Riedl | 74/61 |
| 4,440,034 | A * | 4/1984 | Waschulewski | 74/61 |
| 4,779,418 | A * | 10/1988 | Artzberger | 180/272 |
| 5,010,778 | A * | 4/1991 | Riedl | 366/128 |
| 5,347,884 | A * | 9/1994 | Garnjost et al. | 248/554 |
| 5,439,314 | A * | 8/1995 | Wadensten | 404/133.05 |
| 5,757,158 | A | 5/1998 | Ferguson et al. | |
| 6,276,230 | B1 * | 8/2001 | Crum et al. | 180/170 |
| 6,435,767 | B1 * | 8/2002 | Steffen | 404/133.05 |
| 6,448,768 | B1 * | 9/2002 | Ishibashi et al. | 324/117 H |

FOREIGN PATENT DOCUMENTS

| | | |
|---|---|---|
| DE | 87 14 812 | 3/1989 |
| DE | 196 48 419 | 5/1997 |
| DE | 197 56 475 | 6/1998 |
| DE | 298 04 047 | 6/1998 |

* cited by examiner

*Primary Examiner* — Raymond Addie
(74) *Attorney, Agent, or Firm* — Boyle Fredrickson, S.C.

(57) ABSTRACT

At the end of a guide handle of a vibration plate service as soil-compactor an actuating element is mounted which can be moved in relation to the guide handle. Each position of the actuating element is detected by a sensor device which transmits a corresponding signal to a hydraulic steering unit. In this way, the phase angles of unbalance masses can be modified which in turn influences the direction of travel of the vibration plate.

20 Claims, 2 Drawing Sheets

SOIL-COMPACTOR WITH POWER STEERING

BACKGROUND OF THE INVENTION

1. Field of the Invention

This invention pertains to a soil compaction device according to the preamble of patent claim 1.

2. Description of the Related Art

Soil compaction devices of this type, for example a vibration plate with the type designation "Wacker DPU 7060", are well known and have proven themselves in practice to be excellent, especially in compacting mainly coarse-grained or weakly agglomerating soils. Here, an oscillator driven by a motor is attached to a soil contact plate and sets the soil contact plate into vertical oscillation which then is transferred to the soil. The oscillation produced usually has a constant or even a variable horizontal force component that provides a forward, backward or steering motion of the vibration plate. In the process, the horizontal motion of the vibration plate is supported by the operator through a center guide post or a guide handle. At the center guide post, an operating lever can be provided that is coupled to hydraulic valves, with the help of which the direction of motion of the vibration plate can be adjusted using a hydraulic positioning system. Another known method is to perform the steering and direction functions using a remote control unit. In these remote controlled plates, the steering is commonly done by providing the oscillator with separate eccentric weights that are adjusted so as to work against one another and produce a circular or yawing motion of the machine.

Even with remote controlled vibration plates, the operator can always manually control the motion or steering process by pulling on the guide handle. The operator must press buttons on the remote control and at the same time pull buttons on the guide handle. This requires a large amount of force since the guide handle of remote controlled machines is much shorter than the center guide posts of non remote-controlled machines. Since the operator must simultaneously activate other operator elements der control such as control sticks, pushbuttons or the like, he can only hold the guide handle with one hand. This type of operation is very strenuous for the operator and thus is not beneficial to work progress.

The objective of this invention is to provide a soil compaction device that is easy for the operator to manually steer even when it is equipped with a remote control unit or with pushbuttons on an operator panel.

OBJECTS AND SUMMARY OF THE INVENTION

This objective is met according to the invention by a soil compaction device with the features of patent claim 1. Advantageous developments of the invention are found in the dependent claims.

This invention is characterized in that a sensor unit is provided to determine the position of at least one operator element. This sensor produces a signal to control a positioning unit for the oscillator. This makes it possible for the operator to activate the positioning unit through the operator element without the need to provide additional cost-intensive and maintenance-intensive hydraulic valves at the operator element—as is the state of the technology.

In an especially advantageous development of the invention, the operator element and the sensor unit are attached to a guide handle of the soil compaction device. When the operator now activates the moving operator element, without the expenditure of large amounts of force, and thus moves it from an initial position, the change in position is detected by the sensor unit and a corresponding signal is sent to the positioning unit. In a known fashion, the positioning unit changes the position or phase of the rotating eccentric masses with respect to one another, whereupon the horizontal component of the resultant overall force changes and a change in the directional behavior of the vibration plate is produced.

Suitable operator elements include—depending on the equipment of the vibration plate—one or two handles that are moveable together or separately. Furthermore, the operator element can also be designed in the form of a "joystick".

It is especially advantageous if the invention is used in vibration plates with remote control wherein the device itself has only pushbuttons—if it has any at all—for the direct actuation of hydraulic valves of the hydraulic positioning unit at it has only a short guide handle. Having an additional moving operator element with a sensor unit ensures that the operator can comfortably guide the vibration plate in the same way as a vibration plate without remote control.

BRIEF DESCRIPTION OF THE DRAWINGS

This and other features and advantages of the invention are explained in more detail below using an example and with the help of the accompanying figures.

Shown are.

DETAILED DESCRIPTION OF THE PREFERRED EMBODIMENTS

Figure 1:
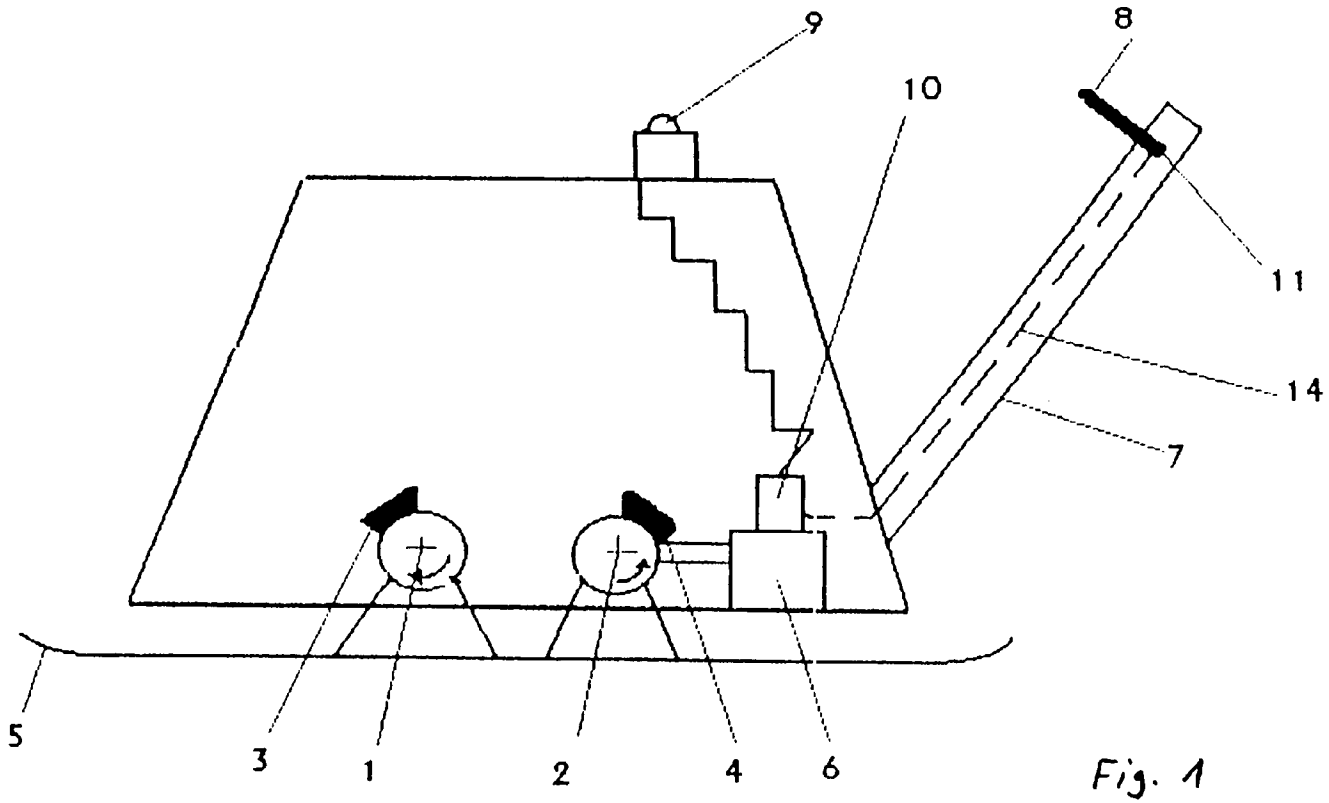
FIG. 1 a schematic side view of a soil compaction device according to the invention.

FIG. 1 shows a soil compaction device according to the invention in a schematic side view in the form of a vibration plate whose basic design is known and is only briefly depicted below.

A motor, not shown, drives two shafts 1, 2 in opposite directions through a drive unit in the direction of the arrow in FIG. 1. Each shaft has an eccentric mass, 3, 4, respectively, on it. The rotation of the eccentric masses produces an essentially vertically directed oscillation that is transferred to the soil to be compacted by means of a soil contact plate 5.

The shafts 1, 2 as well as the eccentric masses 3, 4 can each be separated in the axial direction so as to produce a yawing moment—at the right phase relationship—which makes the vibration plate rotate at a point or—with simultaneous forward motion—travel about a curved radius.

The change of the phase relationship of the shafts 1, 2 to one another as well as the phase relationship of two eccentric masses on one shaft is done using a known positioning unit in which suitable control elements, not shown, are shifted by means of a hydraulic system 6, which is also a part of the positioning unit.

The fluid stream in the hydraulic system 6 can be influenced in various ways according to the state of the technology:

There are vibration plates known with a control handle 8 at the end of a center guide post 7 or guide handle 7 serving as an operator element. This control handle tilts at the end of the center guide post 7 and directly activates a hydraulic valve belonging to the hydraulic system 6.

In a remote-controlled vibration plate, a receiver unit 9 is provided at the vibration plate that receives radio or infrared signals from a sending unit, not shown. It is also common to receive electrical signals over a cable remote control unit. The signals are converted in the receiver unit 9 and actuate electromagnetic valves provided in the hydraulic system 6 through a hydraulic system controller 10.

These types of remote-controlled vibration plates primarily have the center guide post 7 designed as a short guide handle. Moreover, there are often no additional operator elements provided on the vibration plate itself since the operation is to be done through the sending unit only. For cable remote control systems, however, vibration plates are known in which the sending unit can be inserted into a corresponding receptacle in the vibration plate and then be used as an operator panel.

In manually correcting the motion of the vibration plate, the operator must pull the short guide handle with one hand and at the same time activate the remote control or suitable pushbuttons on the operator panel with the other hand in order to attain the desired motion of the vibration plate.

In order to make this easier for the operator, an additional moving control handle 8 is provided on the short guide handle 7 whose change in position does not directly cause a change in the position of a hydraulic valve, but rather is detected by a sensor unit 11 that is likewise located at the end of the guide handle 7.

The sensor unit 11 can be constructed in the form of a Hall generator, a proximity switch or can be built of reed contacts. It converts the respective position of the control handle 8 into an electrical signal that is fed to the hydraulic system controller 10. As sensors for the sensor unit 11, capacitive, inductive and resistive sensors are suitable and must be located near the control handle 8.

In the hydraulic system controller 10, the signal is electromechanically converted, for example by means of an electromagnetic control element that acts on the hydraulic system 6 and thus influences the phase relationship of the shafts 1, 2, and the eccentric weights 3, 4 in the oscillator.

The steering of the vibration plate is thus accomplished through a type of servo control.

Figure 3:
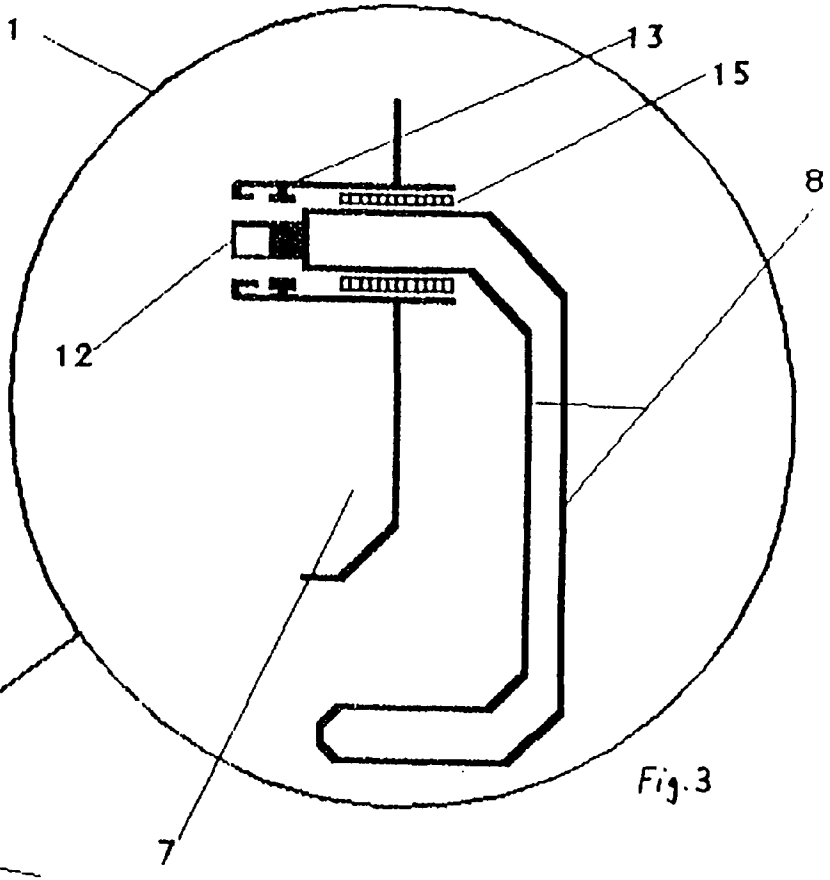
FIG. 3 a schematic sectional enlargement of the operator area of FIG. 2.
Figure 2:
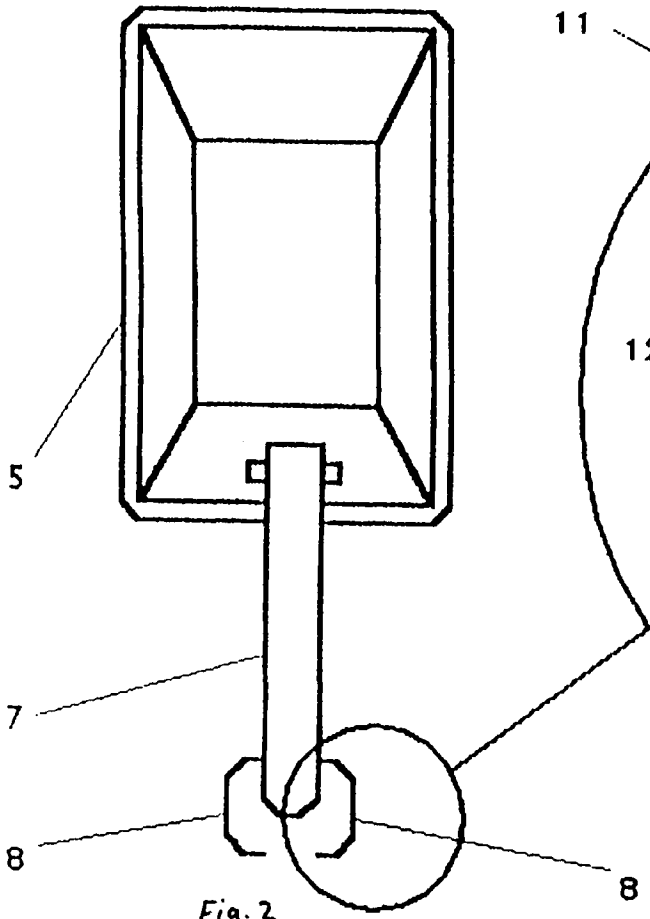
FIG. 2 a top view of the soil compaction device.

FIGS. 2 and 3 show a schematic top view of the vibration plate according to the invention, wherein FIG. 3 is a sectional enlargement of FIG. 2.

At the end of the center guide post 7, there are two control handles 8 serving as operator elements where the operator can guide the machine. Each of the control handles 8 can be rotated relative to the center guide post 7 resulting in the motion or steering behavior of the vibration plate changing. Instead of the center guide post 7, the control handle 8 can also be located on a shorter guide handle.

Each control handle 8 is inserted into the sensor unit 11 and has a transmitting magnet 12 at its end that is opposite a Hall sensor 13. Through the motion of the transmitting magnet 12 at the hall sensors 13, an electrical voltage is produced that is fed as a signal through a line 14 to the hydraulic controller 10.

To dampen the oscillation of the control handle 8, a rubber element 15 can be attached in the form of a collar.

Instead of the Hall sensor 13 described, other sensor units are also possible, for example proximity switches, reed contacts, etc.

If, as shown in FIG. 2, two independently moving control handles 8 are provided, not only can the direction of travel (forward, backward, standstill) of the vibration plate be adjusted, but also a steering or circular motion can be accomplished, provide the oscillator is so equipped.

The control handle 8 can moreover be acted upon by a spring, not shown, in order to be held in a zero position when it is not activated so that the vibration plate always falls back into a safe state in its zero position. In this state, it makes no motion of its own outside of its vertical oscillatory motion. In the zero position, the horizontal forces produced by the eccentric weights neutralize each other such that the resulting overall force has no horizontal component.

I claim:

1. A soil compaction device comprising:

a soil contact plate;

an oscillator that acts on the soil contact plate, has at least two eccentric masses that rotate in opposite directions whose phase relationship can be adjusted relative to one another by a positioning unit in order to control the direction of soil compaction device travel and to steer the soil compaction device in a yawing motion; and at least one manually engageable rotatable power steering control lever configured to control the positioning unit via an electric signal:

wherein a sensor unit is provided to determine the position of the power steering control lever and to produce a signal to control the positioning unit so as to control the direction of soil compaction device travel and steer the soil compaction device in response to manipulation of the power steering control lever.

2. A soil compaction device according to claim 1, wherein the power steering control lever and the sensor unit are attached to a guide handle of the soil compaction device.

3. A soil compaction device according to claim 1, wherein the sensor unit has at least one capacitive, inductive or resistive sensor.

4. A soil compaction device according to claim 1, wherein the sensor unit has at least one Hall sensor or a reed contact as well as a transmitting element attached to the power steering control lever.

5. A soil compaction device according to claim 1, wherein the sensor unit has at least one proximity switch.

6. A soil compaction device according to claim 1, wherein the positioning unit has a fluid-activated piston/cylinder unit as well as an electromechanical valve controlled by the signal from the sensor unit to control a fluid stream at the piston/cylinder unit.

7. A soil compaction device according to claim 1, wherein two power steering control levers are provided that move independent of one another and through which the phase relationship of a group of rotating eccentric masses can be changed.

8. A soil compaction device according to claim 1, wherein the power steering control lever can be tilted away from a spring effect from a zero position, and in this zero position its overall force resulting from the rotating eccentric masses has no horizontal component.

9. A soil compaction device according to claim 1, wherein, in addition to the power steering control lever, a remote control unit is provided with a sending unit that can be spatially separated from the soil compaction device and with a receiving unit attached to the soil compaction device, wherein a signal can be produced by the receiver unit to control the positioning unit.

10. The soil compaction device of claim 1, further including a pair of dampening elements to correspondingly dampen oscillation of the power steering control levers.

11. The soil compaction device of claim 10, wherein the power steering control levers are supported by a guide handle coupled to the positioning unit, and wherein the dampening elements are disposed intermediate the power steering control levers and the guide handle.

12. The soil compaction device of claim 11, wherein the dampening elements comprise rubber collars.

13. A soil compaction device comprising:

a soil contact plate having a guide handle;

a positioning unit;

an oscillator that acts on the soil contact plate, has at least two eccentric masses that rotate in opposite directions whose phase relationship can be adjusted relative to one another using the positioning unit in order to control the direction of soil compaction device travel and to steer the soil compaction device in a yawing motion; and rotatable power steering control handle that is mounted on the guide handle and that is configured to generate electrical command signals upon manual engagement thereof for steering the soil compaction device and for controlling the direction of compaction device travel;

a sensor unit located remote from the power steering control handle, wherein the sensor unit determines the position of the power steering control handle and produces a corresponding signal to control the positioning unit in order to steer the soil compaction device and to control the direction of soil compaction device travel.

14. A soil compaction device according to claim 13, wherein the power steering control handle comprises two independently movable control handles.

15. A soil compaction device according to claim 13, wherein each sensor unit has at least one capacitive, inductive or resistive sensor.

16. A soil compaction device according to claim 13, wherein each sensor unit has at least one Hall sensor or a reed contact as well as a transmitting element attached to the corresponding power steering control handle.

17. A soil compaction device according to claim 13, wherein the positioning unit has a fluid-activated piston/cylinder unit as well as an electromechanical valve controlled by the signal from the sensor unit to control a fluid stream at the piston/cylinder unit.

18. A soil compaction device according to claim 13, wherein the two power steering control handles move independent of one another and through which the phase relationship of a group of rotating eccentric masses can be changed.

19. The soil compaction device according to claim 11 wherein the power steering control handle comprises a joystick.)

20. The soil compaction device according to claim 1 wherein the power steering control lever comprises a joystick.

* * * * *